US006000579A

United States Patent [19]

Sugimoto et al.

[11] Patent Number: 6,000,579

[45] Date of Patent: Dec. 14, 1999

[54] CAP FOR A SPRAY CAN, A SPRAY CAN WITH THE CAP AND A METHOD FOR DISCHARGING RESIDUAL LIQUID AND GAS IN A SPRAY CAN

[75] Inventors: Hiromasa Sugimoto; Shizuo Maruyama, both of Osaka, Japan

[73] Assignee: Asahipen Corporation, Osaka, Japan

[21] Appl. No.: 09/009,204

[22] Filed: Jan. 20, 1998

[30] Foreign Application Priority Data

Jan. 21, 1997 [JP] Japan ..... 9-023252

[51] Int. Cl.[6] ..... B67D 1/16; B67D 5/06

[52] U.S. Cl. ..... 222/108; 222/182; 222/187; 222/402.14

[58] Field of Search ..... 222/108, 182, 222/187, 402.12, 402.13, 402.14

[56] References Cited

U.S. PATENT DOCUMENTS

| | | | |
|---|---|---|---|
| 3,744,681 | 7/1973 | Morane | 222/402.12 |
| 4,341,348 | 7/1982 | Dearling | 239/34 |
| 4,426,025 | 1/1984 | Knickerbocker | 222/182 |
| 4,823,986 | 4/1989 | Pearce, III | 222/182 |

*Primary Examiner*—Andres Kashnikow
*Assistant Examiner*—Jorge Bocanegra
*Attorney, Agent, or Firm*—Joseph C. Mason, Jr.; Dennis G. LaPointe; Mason & Associates, PA

[57] ABSTRACT

The present invention provides a cap for a spray can which can discharge residual liquid and gas in a spray can safely at once and sufficiently afford to discharge a great deal of residual liquid. In another embodiment, the invention includes a spray can with the cap and a method for discharging residual liquid and gas in a spray can. The spray can has a recess or a projection on the top panel which is respectively engageable with the outer circumference or the inner circumference of an engage portion surrounding a stem of a can body, an insert hole into which the stem of the can body can be inserted being formed on the recess or the projection at the central part, a narrow portion with a diameter smaller than the outer diameter of the stem of the can body being formed below the insert hole, a stop plate against which residual liquid spouted from a discharge opening of the stem can be hit being arranged at a necessary portion below said narrow portion, two openings being formed at a connection portion of the narrow portion and the stop plate, the top panel of the cap being liquid-proof except for the insert hole, and spouted residual liquid which strikes against the stop plate jetting towards an outer circumference of the cap from said openings by pushing down the stem of the can body with the narrow portion to spout the residual liquid and residual gas.

18 Claims, 9 Drawing Sheets

PRIOR ART

PRIOR ART

CAP FOR A SPRAY CAN, A SPRAY CAN WITH THE CAP AND A METHOD FOR DISCHARGING RESIDUAL LIQUID AND GAS IN A SPRAY CAN

FIELD OF THE INVENTION

This invention relates to a cap for a spray can, a spray can with the cap and a method for discharging residual liquid and gas in a spray can, and provides a cap for a spray can which can discharge residual liquid and gas in a spray can safely.

PRIOR ART

In general, combustible gas is charged into a spray can for coatings, insecticides, cosmetics and so on, to spray liquid from the can.

When such a spray can is dumped, with residual gas inside the can, there is a danger of an explosion of the can which may cause injury to a cleaner or damage to an incinerator required by local governments to dump spray cans after residual gas inside the cans is entirely discharged.

Known main methods to discharge residual gas or liquid inside a spray can can be classified mainly into two ways; one is to drill the can and the other is to go on pushing a spray button.

To drill a spray can is a popular method since a lot of local governments recommend the method. Although a nail or an eyeleteer can be used to drill a spray can, devices used only to drill a spray can as shown in FIG. 13 and FIG. 15 are recently sold.

The device shown in FIG. 13 comprises two coiled springs (C) and a pin (P) arranged between the springs (C), and drills a spray can (K) with the pin (P) by setting the can (K) on curve portions of the springs (C) and treading on the can (K) to deform the coil springs (C).

The device shown in FIG. 15 comprises a needle (H), a sponge (S) surrounding the needle and an adhesive double side tape (T) attached to the surface of the sponge (S) and pierces the needle (H) through a spray can by pressing the sponge (S) with the tape (T) attached to the surface of the spray can.

Japanese patent provisional publication No. JPA 8-324661 entitled "Gas purger, gas purging apparatus, cap used for gas purging and method for purging gas for aerosol container" discloses an art to purge readily residual gas in a used up aerosol container with a cap of the aerosol container.

The above mentioned methods of drilling a spray can presuppose that liquid in a spray can has been almost used up. Therefore when a great deal of liquid is left in a spray can, a problem is caused that the residual liquid is splashed to stain a user's face or clothes, in particularly, when the residual liquid is coating, it is difficult to remove stains from clothes.

When a great deal of liquid is left in a spray can, the method of pushing a spray button to discharge residual gas and liquid requires pushing a button for a long time which taxes a user's finger. In addition, residual liquid is discharged generally in the open air so that, when the residual liquid is coating, the discharged coating may be splashed towards a user according to the wind direction to stain the user's clothes.

The above mentioned JPA 8-324661 entitled "Gas purger, gas purging apparatus, cap used for gas purging and method for purging gas for aerosol containers" only relates to an art to purge gas in an aerosol container premising that the aerosol container has been used up so that it is not suitable to be applied to a spray can with a great deal of liquid left.

The disclosed art in JPA 8-324661 comprises the steps of setting a cap (A) for purging gas upside down to a container (B), pressing a stem (C) with a tapered hole (D) formed through the cap (A), thereby spouting residual. When the cap (A) for purging gas is set to the erected container (B) to discharge both of gas and liquid in a spray can with a great deal of the liquid left, there causes a problem such that the residual liquid is spouted upwardly with vigor to be splashed into eyes of a user and to stain surroundings. The problem can be solved by setting the container (B) upside down on the cap (A), however, a another problem arises, such that only gas can be discharged with residual liquid still left within the container.

The problem to be solved by the present invention is to provide a cap for a spray can which can discharge residual liquid and gas in a spray can safely at once and sufficiently afford to discharge a great deal of residual liquid.

SUMMARY OF THE INVENTION

The present invention relates to a cap for a spray can having a recess or a projection formed on a top panel which is respectively engageable with the outer circumference or the inner circumference of an engage portion surrounding a stem of a can body, an insert hole being formed on the recess or the projection at the central part into which the stem of the can body can be inserted, a narrow portion with a diameter smaller than the outer diameter of the stem of the can body being formed below the insert hole, a stop plate against which residual liquid spouted from a discharge opening of the stem can strike, being arranged at a necessary portion below the narrow portion, two openings being formed at a connection portion of the narrow portion and the stop plate, the top panel of the cap being liquid-proof except for the insert hole, and spouted residual liquid which strikes against the stop plate jetting substantially towards an outer circumference of the cap from the openings by pushing down the stem of the can body with the narrow portion to spout the residual liquid and residual gas. The cap has the effect that substantially all of residual gas and liquid in a spray can can be automatically discharged very readily only by setting the cap to the spray can body without steps required for prior methods such as pushing a spray button for a long time or drilling a spray can body and that discharged liquid never stains a user nor surroundings since spouted liquid jets towards an outer circumference of the cap by means of the stop plate.

The present invention further comprises a liquid absorber arranged inside the cap in advance before using or can be arranged inside the cap. The cap has an effect that discharged residual liquid can be absorbed by the liquid absorber and never spills from the cap in dumping.

The present invention also relates to a spray can having the cap as described above. The spray can has effects that residual gas and liquid in the can body can be discharged only by removing the cap from the can body and setting it upside down to the can body without buying any drilling device and that a user can discharge residual gas and liquid readily and economically.

Moreover, the present invention relates to a method for discharging residual liquid and gas in a spray can comprising the steps of providing a recess or a projection on a top panel of a cap for the spray can which is respectively engageable with the outer circumference or the inner circumference of an engage portion surrounding a stem of a can body, forming an insert hole into which the stem of the can body can be inserted on the recess or the projection at the central part, forming a narrow portion with a diameter smaller than the outer diameter of the stem of the can body below the insert hole, arranging a stop plate against which residual liquid spouted from a discharge opening of the stem can strike at a necessary portion below said narrow portion, forming two openings at a connection portion of the narrow portion and the stop plate, making the top panel as a liquid-proof panel except for the insert hole, erecting the can body and setting the cap upside down with its open surface turning upwardly on the erected can body, and pushing down the stem of the can body with said narrow portion to spout the residual liquid and gas and hitting the spouted residual liquid against the stop plate to jet substantially towards an outer circumference of the cap from the openings with the residual liquid stored within the cap. The method has the effect that substantially all of residual gas and liquid in a spray can can be automatically discharged very readily and that discharged liquid never stains a user.

DETAILED DESCRIPTION OF THE INVENTION

Figure 1:
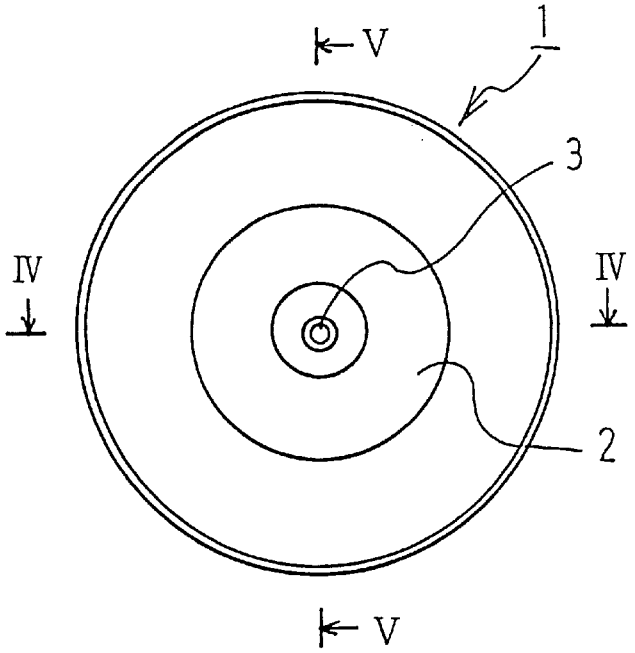
FIG. 1 is a plan view showing a preferred embodiment of a cap for a spray can relating to the present invention.

Preferred embodiments of a cap for a spray can, a spray can with the cap and a method for discharging residual liquid and gas relating to the present invention will be described hereinafter referring to the drawings.

The following description substantially relates to a spray can for coating, however, contents of a spray can used for the present invention are not restricted, and the present invention can be applied for any aerosol spray can having liquid and gas to spray the liquid such as a spray can for insecticides, cosmetics, liquid cleaners, for example glass cleaners, waxes, deodorants, fragrance agents, starches, disinfectants, static electricity preventives, waterproof agents, muscle fatigue recovery agents, mold release agents, rust preventive and lubricating agents, metallic flaw detection agents and so on. In a spray can, gas can be solved in liquid, or can be charged separately from liquid only to add a pressure to spray the liquid.

Figure 2:
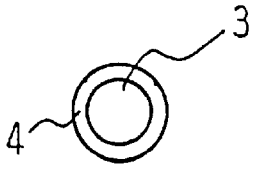
FIG. 2 is an enlarged view of an insert hole in FIG. 1.
Figure 3:
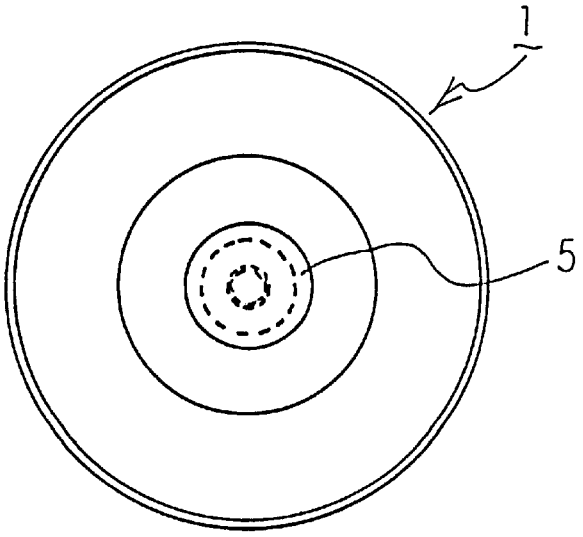
FIG. 3 is a bottom view of FIG. 1.
Figure 4:
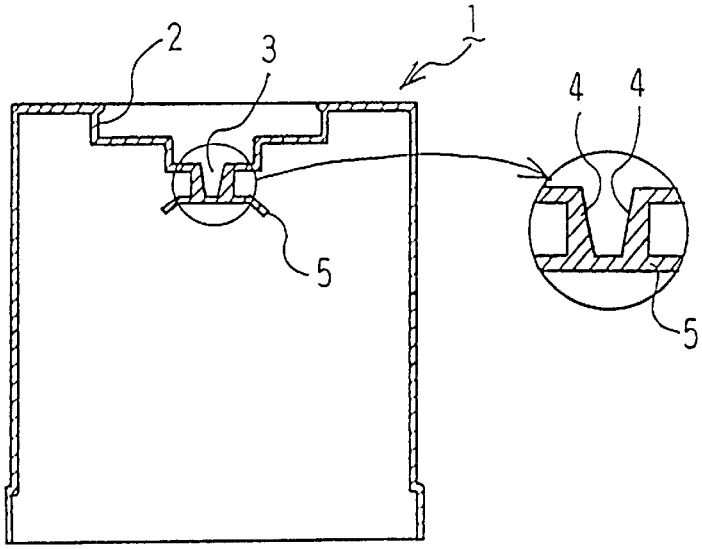
FIG. 4 is a cross sectional view taken along the line IV—IV of FIG. 1.
Figure 5:
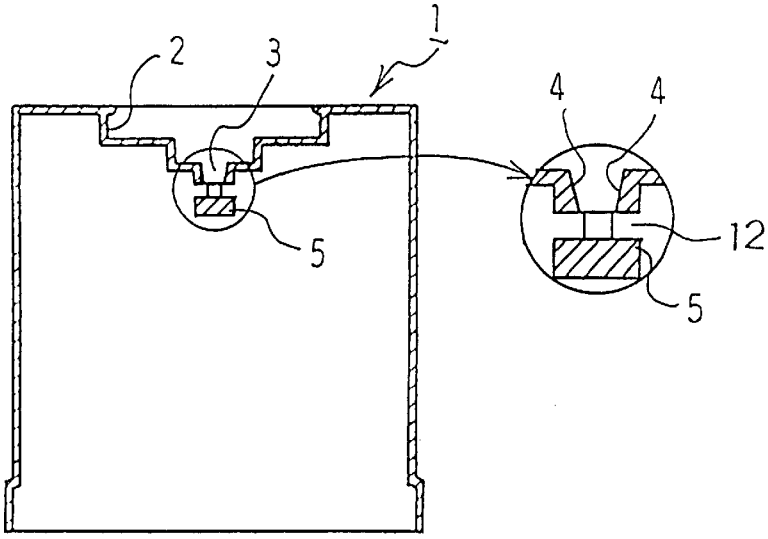
FIG. 5 is a cross sectional view taken along the line V—V of FIG. 1 showing another embodiment.
Figure 6:
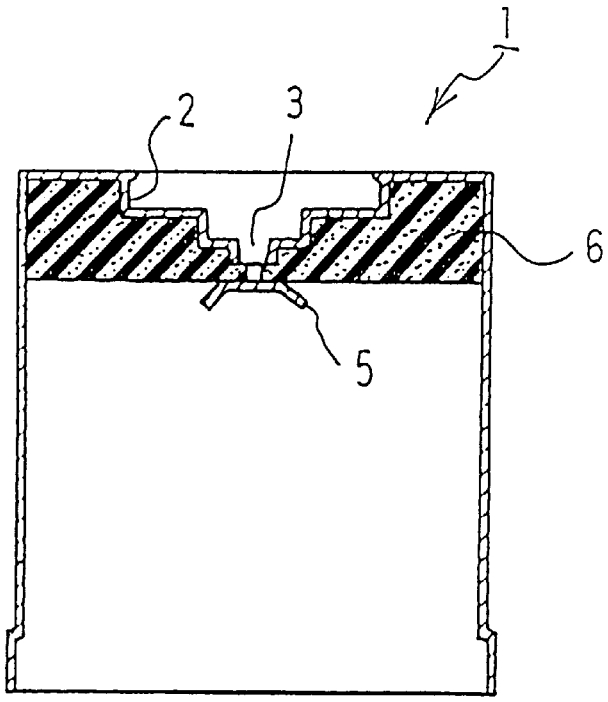
FIG. 6 is a cross sectional view showing a liquid absorber arranged inside a cap.
Figure 7:
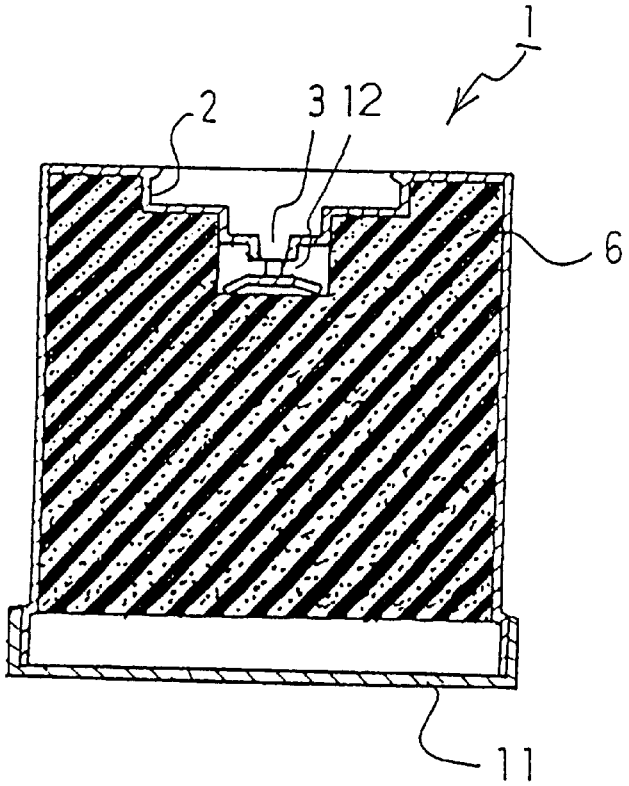
FIG. 7 is a cross sectional view also showing a liquid absorber arranged inside a cap.
Figure 8:
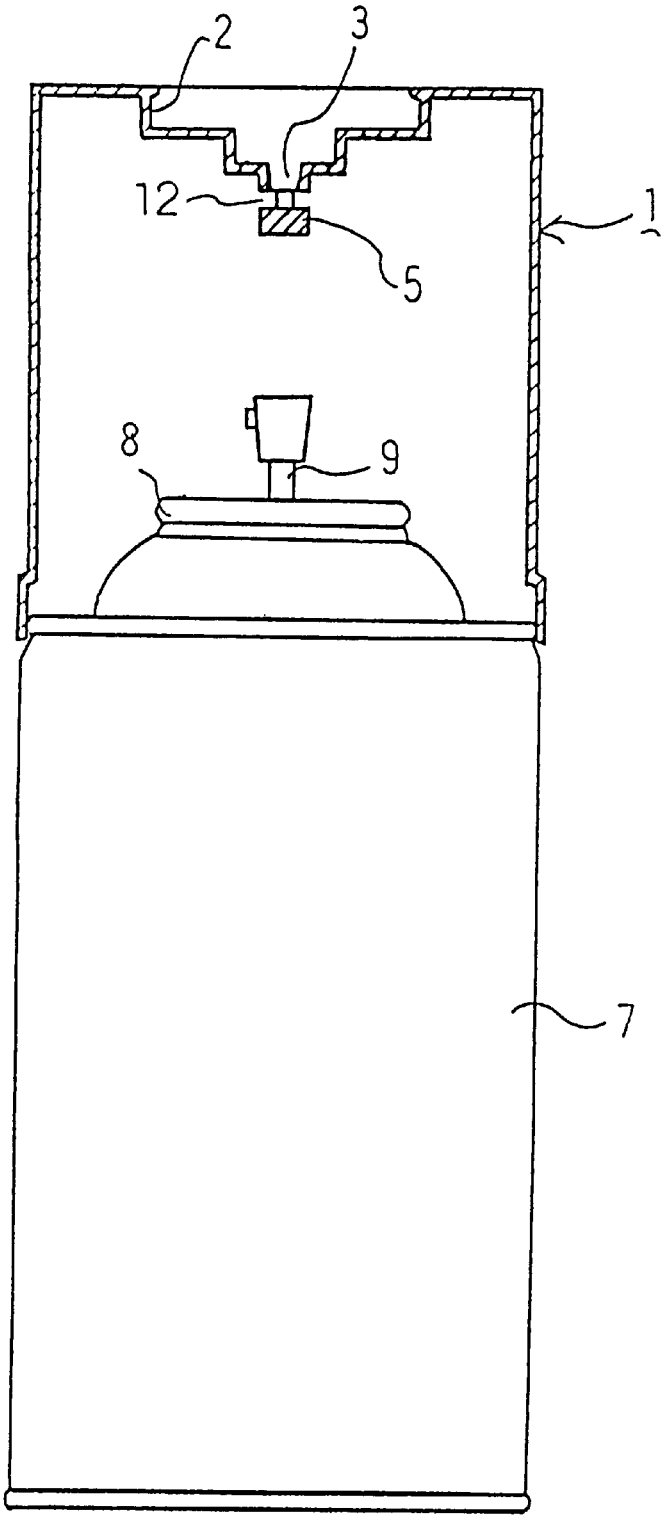
FIG. 8 shows a spray can relating to the present invention.
Figure 9:
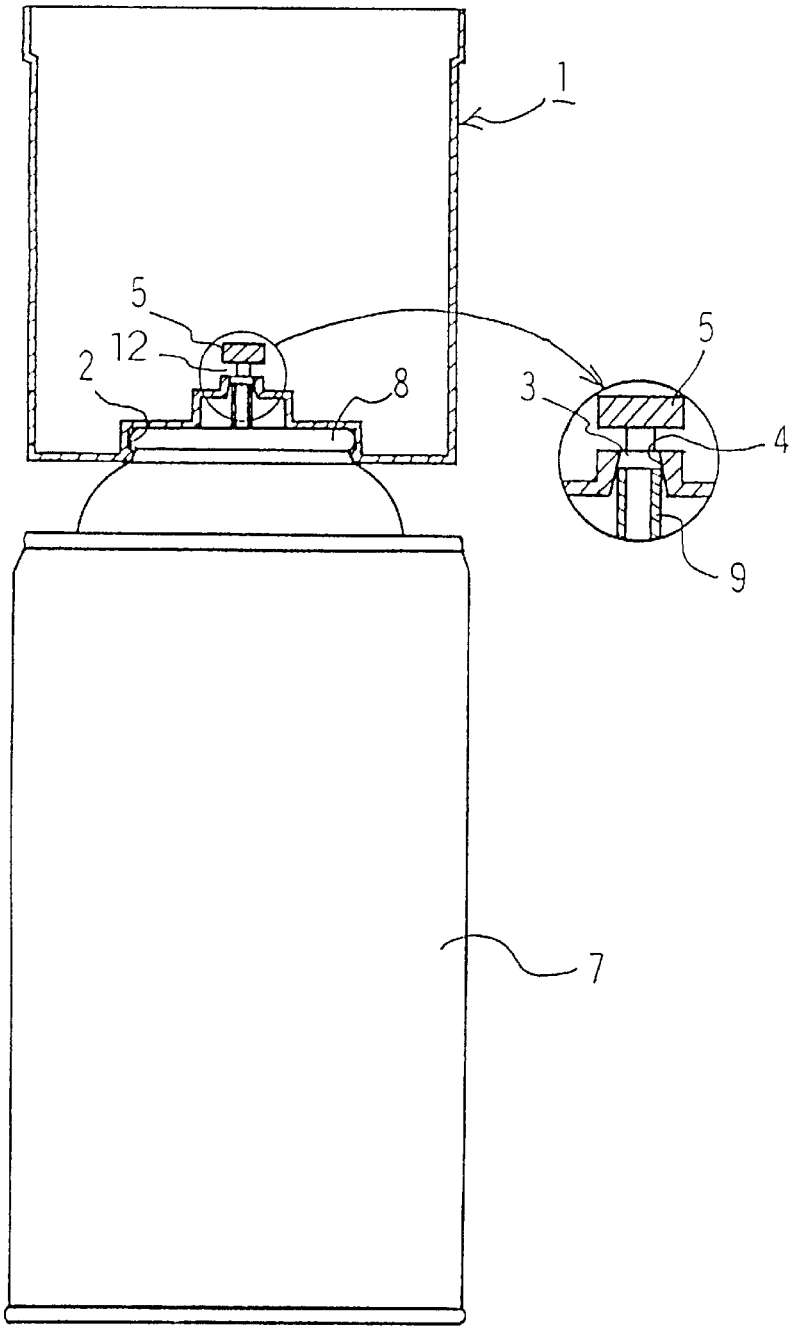
FIG. 9 is a view to explain how to use a cap for a spray can relating to the present invention.
Figure 10:
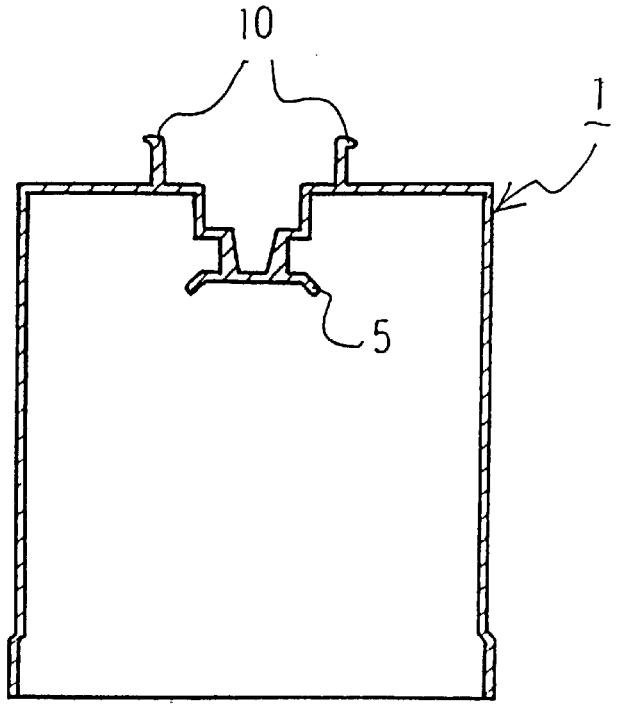
FIG. 10 is a cross sectional view showing further embodiment of a cap for a spray can relating to the present invention.
Figure 11:
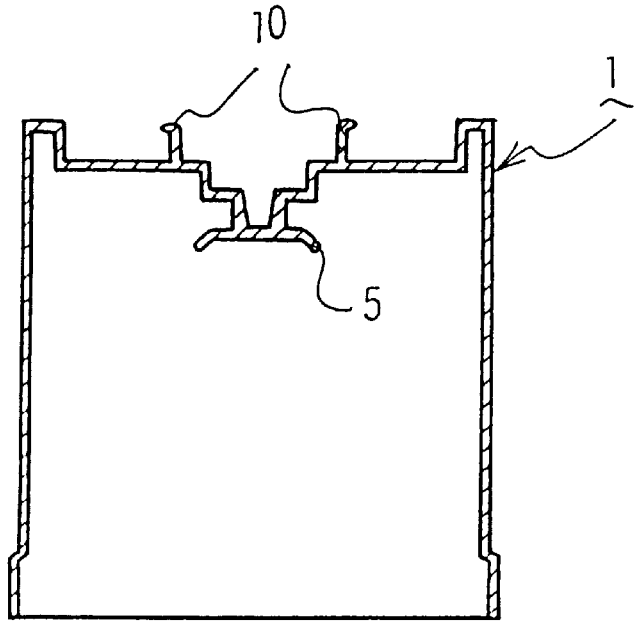
FIG. 11 is a cross sectional view showing still another embodiment of a cap for a spray can relating to the present invention.
Figure 12:
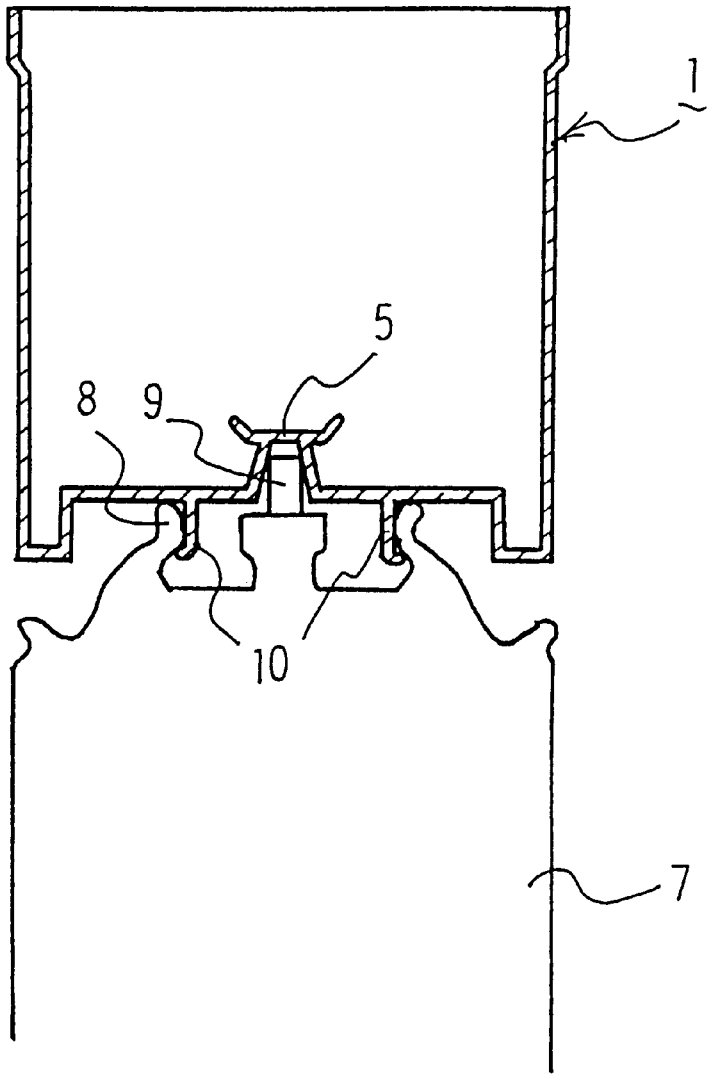
FIG. 12 is a view to explain how to use a cap for a spray can relating to the present invention.

FIG. 1 is a plan view showing a preferred embodiment of a cap for a spray can relating to the present invention; FIG. 2 is an enlarged view of an insert hole in FIG. 1; FIG. 3 is a bottom view of FIG. 1; FIG. 4 is a cross sectional view taken along the line IV—IV of FIG. 1; FIG. 5 is a cross sectional view taken along the line V—V of FIG. 1 showing another embodiment; FIG. 6 is a cross sectional view showing a liquid absorber arranged inside a cap; FIG. 7 is a cross sectional view also showing a liquid absorber arranged inside a cap; FIG. 8 shows a spray can relating to the present invention; FIG. 9 is a view to explain how to use a cap for a spray can relating to the present invention; FIG. 10 is a cross sectional view showing further embodiment of a cap for a spray can relating to the present invention; FIG. 11 is a cross sectional view showing still another embodiment of a cap for a spray can relating to the present invention; and FIG. 12 is a view to explain how to use a cap for a spray can relating to the present invention.

A cap (1) for a spray can relating to the present invention has a recess (2) formed on the top panel which can fit with an engage portion surrounding a stem of a can body and an insert hole (3) into which the stem of the can body can be inserted is formed at the central part of the recess (2). A narrow portion (4) having a diameter smaller than the outer diameter of the stem is formed below the insert hole (3) and a stop plate (5) is arranged at a necessary portion below the narrow portion (4).

In the shown embodiment, the narrow portion (4) is tapered downwardly to reduce the diameter gradually to the bottom (to an open surface of the cap).

The size and shape of the stop plate (5) are not especially restricted. The stop plate may be formed as a disk of a size much larger than that of a discharge opening of the stem as shown in FIG. 4, or may be formed as a plate of a size a little larger than that of the discharge opening in FIG. 5. The stop plate (5) favorably has a size which can cover at least 60% of the size of the discharge opening (the inner circumference) of the stem.

If the stop plate (5) has a size which covers less than 60% of the size of the discharge opening, in discharging of residual liquid and gas, residual liquid which can not strike against the stop plate (5) has a stronger power than the rest of residual liquid which can strike against the stop plate (5) to jet towards the outer circumference of the cap from two openings so that a part of or most of residual liquid jets straight towards the open surface of the cap.

While, if the stop plate (5) has a size which can cover at least 60% of the size of the discharge opening, in discharging residual liquid, residual liquid which can strike against the stop plate (5) to jet towards the outer circumference of the cap from two openings has a stronger power than the rest part of residual liquid which can not strike against the stop plate (5) to jet straight towards the open surface of the cap so that residual liquid jets towards the outer circumference of the cap upwardly and somewhat obliquely to prevent surely an accident such that the jetted liquid is splashed into eyes of a user.

Note that it is also within the scope of the present invention that the stop plate (5) has a size which can cover less than 60To of the size of the discharge opening of the stem.

FIG. 5 shows the stop plate (5) which has a smaller size (a less diameter) than that in FIG. 4 and two openings (12) formed at a connecting portion of the stop plate (5) and the narrow portion (4). At the connecting portion, the stop plate (5) is connected with the narrow portion in the cross section along the line IV—IV of FIG. 1 (ref. FIG. 4), however, the openings (12) are provided in the cross section along the line V—V of FIG. 1.

In a discharge of residual liquid which will be described later, residual liquid hits against the stop plate (5) and jets towards the outer circumference when the stop plate (5) is formed as shown in FIG. 4, and it hits against the stop plate (5) and jets upwardly (to the open surface of the cap) and somewhat obliquely when the stop plate (5) is formed as shown in FIG. 5.

Except for the insert hole (3), the top panel is liquid-proof so that liquid discharged into the cap (1) which is turned upside down never leaks out of the cap (1).

The capacity of the cap (1) for a spray can be suitably changed according to amount or kind of liquid charged into the spray can. The capacity of the cap (1) for a spray can for a fragrance agent comprising almost gas can be decreased relative to the capacity of a can body, and the capacity of the cap (1) for a spray can for a glass cleaner comprising almost liquid can be increased relative to the capacity of a can body.

The cap (1) for a spray can for coating favorably has a capacity from 0.45 to 5.50 times as much as the volume of coating charged into the can body. If the cap (1) for a spray can has a capacity less than 0.45 times as much as the volume of coating charged into the can body, residual coating may spill from the cap (1) with the liquid absorber (6) when the residual coating is discharged. While, if the cap (1) for a spray can has a capacity more than 5.50 times as much as the volume of coating charged into the can body, the cap is inconvenient to a user to handle because it is too big.

For example, 80–170 ml of coating is generally charged into a spray can with a capacity of 300 ml, then the cap (1) for the spray can having a capacity of about 200 ml (about from 1.18 to 2.50 times as much as the volume of the spray can body) can be favorably used so that discharged coating never spills from the cap (1) in discharging residual coating and a user never feels inconvenient about the cap (1) because it is not so big.

It is preferable to arrange a liquid absorber (6) inside the spray can (1) as shown in FIG. 6.

The liquid absorber (6) can be arranged inside the cap (1) in advance, or can be arranged by a user before dumping a spray can.

When the liquid absorber (6) is arranged inside the cap (1), it is favorable to attach an adhesive tape or a cover to the open surface of the cap to prevent the liquid absorber (6) from spouting out of the cap (1). In any cases, the cap (1) should not be shut up to discharge gas.

FIG. 7 is a cross sectional view showing that a user arranges the liquid absorber (6) into the cap (1) and attaches a cover (11) to the open surface of the cap (1) before he dumps a spray can.

It is favorable to use felt, sponge, water-absorptive paper, oil-absorptive paper, sawdust, cloth and so on individually or conbinationally as the liquid absorber (6). Material and size of the liquid absorber (6) are preferably determined to be able to absorb liquid charged in a spray can body entirely.

The cap for a spray can formed as described above is attached to the spray can body (7) as shown in FIG. 8 and sold.

When a spray can is to be dumped with liquid left inside the can, the cap (1) for the spray can is turned upside down to engage the recess (2) with an engage portion (8) surrounding a stem (9) of the spray can body with the stem (9) inserted into the insert hole (3) formed at the central part of the recess (2).

Thereby the stem is pushed down by the tapered face forming the narrow portion (4) so that residual liquid and gas are discharged at once when the spray can is charged with liquid into which gas is dissolved such as coating, and, when the spray can is charged with liquid and gas separately such as glass cleaner, residual liquid is first discharged and then residual gas is discharged. In discharging residual liquid, the discharged liquid strikes against the stop plate (5) to jet towards the outer circumference of the cap upwardly and somewhat obliquely, namely towards an outer wall of the cap (1) and can hardly be splashed out of the cap since the stop plate (5) of a size which can cover at least 60% of size of the discharge opening of the stem (9) is provided below the narrow portion (4). The discharged liquid can be absorbed by the liquid absorber (6) if it is arranged inside the cap (1) as shown in FIG. 6 or FIG. 7.

As described above, residual liquid and gas can be almost entirely discharged automatically only by attaching the cap (1) upside down to the spray can body (7).

In aforesaid examples, the cap (1) for a spray can relating to the present invention is engageable with the outer circumference of an engage portion surrounding a stem of a spray can body, however, the cap (1) may be engageable with the inner circumference of the engage portion. Each of FIGS. 10–12 is a cross sectional view showing the cap (1) engageable with the inner circumference of the engage portion and the cap (1) is attached to the spray can body (7) as shown in FIG. 12 by forming a projection (10) on the top panel of the cap (1) and engaging the projection (10) with the inner circumference of the engage portion (8) surrounding the stem of the spray can body (7). The working of the cap is not described here since it is as same as that of the aforesaid examples.

The effects of the cap for a spray can and the spray can with the cap of the present invention will be described more clearly in the following embodiments and comparative tests. Note that the present invention is not restricted to the following embodiments.

[EMBODIMENT 1]

A foamed urethane sponge "MOLTOPREN SF", trade name of a sponge produced by the Inoac Corp., of a height of 20 mm which was cut into a cylindrical shape to be adjusted to the inner diameter of a cap for a spray can relating to the present invention was arranged inside the cap as a liquid absorber and kept not to come out of the cap by attaching cellulose adhesive tapes crosswise to the bottom of the cap spacing from the liquid absorber, and, as shown in FIG. 9, the cap was set to an erected coating spray can with 14 g (about 17 ml) of residual liquid and 2.2 kg/cm$^2$ of the internal pressure for white lacquer (Trade Name "LACQUER SPRAY WHITE—300 ml SIZE" produced by Asahipen Corp.) of which spray button is removed.

As a result, the residual liquid was discharged for about 25 seconds to be absorbed by the foamed urethane sponge with no leak out of the cap. After the can was kept for 10 minutes without any processing, the internal pressure was 0 kg/cm$^2$ and the weight of the residual coating was 2.8 g.

[EMBODIMENT 2]

About 20 g of soft cotton cloth as a liquid absorber was stuffed into a cap relating to the present invention and kept not to come out of the cap by attaching kraft adhesive tapes to the bottom of the cap spacing from the liquid absorber, and, as shown in FIG. 9, the cap was set to an erected coating spray can with 41 g (about 50 ml) of residual liquid and 2.5 kg/cm$^2$ of the internal pressure for white lacquer (Trade Name "LACQUER SPRAY WHITE—300 ml SIZE" produced by Asahipen Corp.) of which spray button was removed.

As a result, residual liquid was discharged for about 90 seconds to be absorbed by the cotton cloth with no leak out of the cap. After the can was kept for 10 minutes without any processing, the internal pressure was 0 kg/cm$^2$ and the weight of residual coating was 3.2 g.

[EMBODIMENT 3]

8 sheets (about 9.4 g) of soft tissue paper (facial tissues produced by Crecia Corp.) as a liquid absorber was stuffed into a cap relating to the present invention and kept not to come out of the cap by attaching cellulose adhesive tapes to the bottom of the cap spacing from the liquid absorber, and, as shown in FIG. 9, the cap was set to an erected coating spray can with 85 g (about 100 ml) of residual liquid and 3.6 kg/cm$^2$ of the internal pressure for white acrylic resin coating (Trade Name "SPRAY FOR VARIOUS USES WHITE—300 ml SIZE" produced by Asahipen Corp.) of which spray button was removed.

As a result, residual liquid was discharged for about 2 minutes to be absorbed by the tissue paper with no leak out of the cap. After the can was kept for 10 minutes without any processing, the internal pressure was 0 kg/cm$^2$ and the weight of residual coating was 3.5 g.

[EMBODIMENT 4]

Except for setting a cap relating to the present invention to a coating spray can with 83 g (about 100 ml) of residual liquid and 2.6 kg/cm$^2$ of the internal pressure for white coating for marking (Trade Name "MARKING SPRAY WHITE—300 ml SIZE" produced by Asahipen Corp.), a test was conducted in the same manner as Embodiment 3.

As a result, residual liquid was almost discharged for about 4 minutes to be absorbed by the tissue paper with no leak out of the cap. After the can was kept for 10 minutes without any processing, the internal pressure was 0 kg/cm$^2$ and the weight of residual coating was 3.1 g.

[EMBODIMENT 5]

After spraying a half of coating inside an unused spray can for white coating for marking (Trade Name "MARKING SPRAY WHITE—300 ml SIZE" produced by Asahiper Corp.) by pushing a spray button (for about 4 minutes) without staining surroundings, 8 sheets (about 16 g) of paper towel (Trade Name "COOPSTYLE" produced by Crecia Corp.) as a liquid absorber was stuffed into a cap relating to the present invention and kept not to come out of the cap by attaching kraft adhesive tapes to the bottom of the cap spacing from the liquid absorber, and, as shown in FIG. 9, the cap was set to the erected spray can of which spray button is removed.

As a result, residual liquid was discharged for about 3 minutes to be absorbed by the paper towel with no leak out of the spray can. After the can was kept for 10 minutes without any processing, the internal pressure was 0 kg/cm$^2$ and the weight of residual coating was 2.9 g.

[EMBODIMENT 6]

6 sheets (about 7.0 g) of soft tissue paper (facial tissues produced by Crecia Corp.) as a liquid absorber was stuffed into a cap relating to the present invention and kept not to come out of the cap by attaching cellulose adhesive tapes to the bottom of the cap spacing from the liquid absorber, and, as shown in FIG. 9, the cap was set to an erected unused spray can for white water base acrylic resin coating (Trade Name "WATER BASE MINI SPRAY WHITE—100 ml SIZE" produced by Asahipen Corp.) of which spray button was removed.

As a result, residual liquid was discharged for about 150 seconds to be absorbed by the tissue paper with no leak out of the cap. After the can was kept for 10 minutes without any processing, the internal pressure was 0 kg/cm$^2$ and the weight of residual coating was 2.4 g.

[COMPARATIVE TEST 1]

Coating inside an unused spray can for white coating for marking (Trade Name "MARKING SPRAY WHITE—300 ml SIZE" produced by Asahipen Corp.) was sprayed to the outside of the spray can by pushing a spray button.

As a result, coating could no longer be sprayed after about 9 minutes from starting pushing the button and a finger was released from the button. Then, after the can was kept for 10 minutes without any processing, the internal pressure was 0.2 kg/cm$^2$ and the weight of residual coating was 4.5 g.

[COMPARATIVE TEST 2]

Figure 13:
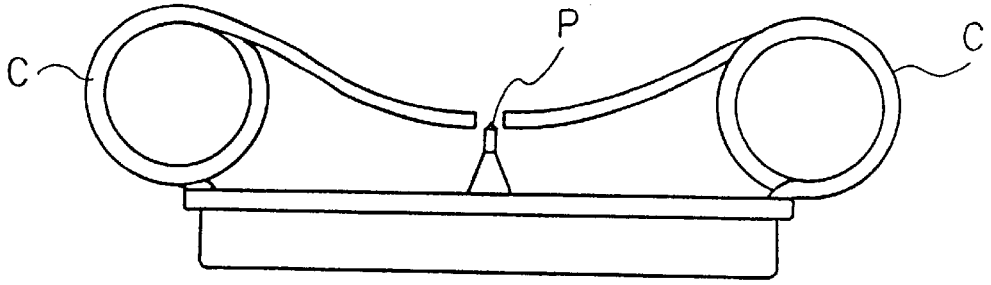
FIG. 13 is a view showing one example of prior drill devices used to discharge residual gas in a spray can.
Figure 14:
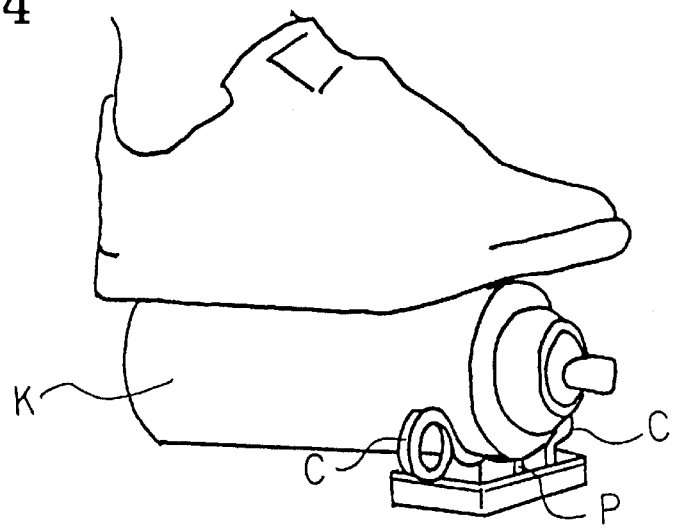
PRIOR ART FIG. 14
FIG. 14 is a view showing how to use the device of FIG. 13.

A spray can with 14 g (about 17 ml) of residual liquid and 2.2 kg/cm$^2$ of the internal pressure for white lacquer (Trade Name "LACQUER SPRAY WHITE—300 ml SIZE" produced by Asahipen Corp.) was drilled as shown in FIG. 14 by a foot operated drill device of FIG. 13.

As a result, all the residual coating was splashed out the moment a foot was released from the device to stain surroundings within a radius of 2 meters of the spray can.

[COMPARATIVE TEST 3]

Figure 15:
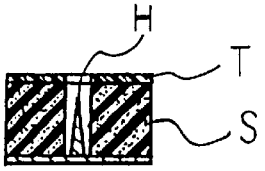
PRIOR ART FIG. 15
FIG. 15 is a cross sectional view showing another example of prior drill devices used to discharge residual gas in a spray can.
Figure 16:
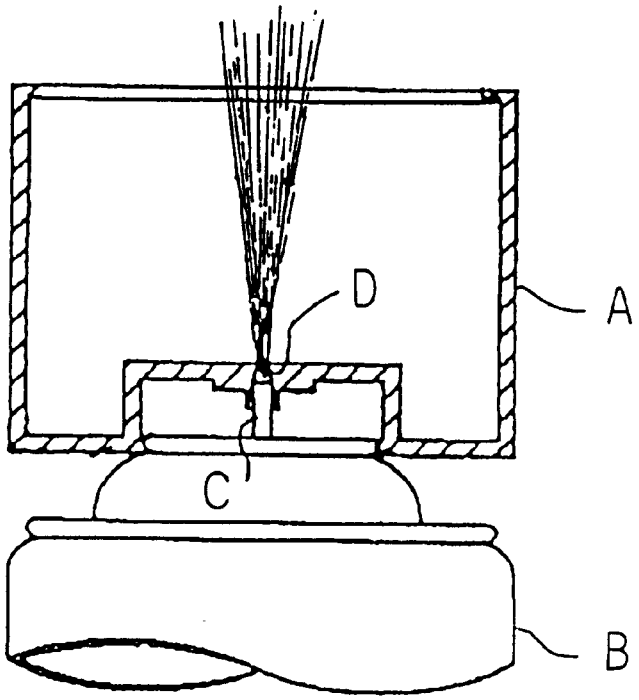
FIG. 16 is a view to explain one example of prior gas purging methods for a spray can.

An unused spray can for white water base acrylic resin coating (Trade Name "WATER BASE MINI SPRAY WHITE—100 ml SIZE" produced by Asahipen Corp.) was pierced by attaching a needle pierce device of FIG. 15 to an upper portion of the can body and pushing the device inwardly with fingers.

As a result, gas was started to be discharged after releasing the fingers from the device and then coating spread through a sponge of the device and flowed down along the can body. After the can was kept for 1 day without any processing, the weight of residual coating was 40 g.

[COMPARATIVE TEST 4]

A spray button was removed from a spray can with 85 g (about 100 ml ) of residual liquid and 3.6 kg/cm$^2$ of the internal pressure for white acrylic resin coating (Trade Name "SPRAY FOR VARIOUS USES WHITE—300 ml SIZE" produced by Asahipen Corp.) and a hole having a diameter of 2 mm was made at a mounting cup of the spray can body with a brass nail and a hammer to discharge gas.

As a result, the moment the nail was removed from the can body, residual coating spouted to a height of 2 m and splashed out within a radius of 3 meters of the spray can. After about 10 seconds, spouting of the residual coating was finished and, after about 120 seconds, a discharge of gas was finished.

After the can was kept for 1 day without any processing, the weight of residual coating was 30 g.

[COMPARATIVE TEST 5]

6 sheets (about 7.0 g) of soft tissue paper (facial tissues produced by Crecia Corp.) as a liquid absorber was stuffed into a cap relating to the present invention and kept not to come out of the cap by attaching cellulose adhesive tapes to the bottom of the cap spacing from the liquid absorber, and the cap was placed on a plane surface with the bottom (the open surface) down. A spray can with 83 g (about 100 ml)

of residual liquid and 2.6 kg/cm$^2$ of internal pressure for white coating for marking (Trade Name "MARKING SPRAY WHITE—300 ml SIZE" produced by Asahipen Corp.) of which spray button was removed was turned upside down to be set to the cap.

As a result, residual liquid was discharged for 2 hours with leaving about 48 g of residual liquid and, after the can was kept for 1 day without any processing, the internal pressure was 0.3 kg/cm$^2$ and the weight of residual coating was 45 g.

The results of the above embodiments 1–6 are shown in Table 1, the results of the above comparative tests are shown in Table 2, and the coatings used for the embodiments and the tests are shown in Table 3.

TABLE 1

| | EMBODIMENT | | | | | |
|---|---|---|---|---|---|---|
| | 1 | 2 | 3 | 4 | 5 | 6 |
| COATING IN SPRAY CAN | LACQUER | LACQUER | VARIOUS USES | MARKING | MARKING | WATER-BASE |
| RESIDUAL COATING | 14 g | 41 g | 85 g | 83 g | 248 g | 85 g |
| INTERNAL PRESSURE | 2.2 kg/cm$^2$ | 2.5 kg/cm$^2$ | 3.6 kg/cm$^2$ | 2.6 kg/cm$^2$ | 3.1 kg/cm$^2$ | 4.0 kg/cm$^2$ |
| USED DEVICE | CAP | CAP | CAP | CAP | CAP | CAP |
| CAPACITY OF DEVICE | 120 ml | 120 ml | 130 ml | 150 ml | 170 ml | 85 ml |
| DISCHARGING METHOD | ERECTION OF CAN BODY | ERECTION OF CAN BODY | ERECTION OF CAN BODY | ERECTION OF CAN BODY | PUSH OF BUTTON ERECTION OF CAN BODY | ERECT-ION OF CAN BODY |
| COATING ABSORBER | URETHANE SPONGE | COTTON CLOTH | TISSUE PAPER | TISSUE PAPER | PAPER TOWEL | TISSUE PAPER |
| RESIDUAL COATING AFTER DISCHARGE | 2.8 g | 3.2 g | 3.5 g | 3.1 g | 2.9 g | 2.4 g |
| INTERNAL PRESSURE AFTER DISCHARGE | 0 kg/cm$^2$ | 0 kg/cm$^2$ | 0 kg/cm$^2$ | 0 kg/cm$^2$ | 0 kg/cm$^2$ | 0 kg/cm$^2$ |
| STAINS AROUND CAN | NO | NO | NO | NO | NO | NO |
| TIME FOR PUSH OF BUTTON | — | — | — | — | 4 MIN. | — |
| TIREDNESS OF FINGER | — | — | — | — | SMALL | — |

TABLE 2

| | COMPARATIVE TEST | | | | |
|---|---|---|---|---|---|
| | 1 | 2 | 3 | 4 | 5 |
| COATING IN SPRAY CAN | MARKING | LACQUER | WATER-BASE | VARIOUS USES | MARKING |
| RESIDUAL COATING | 248 g | 14 g | 85 g | 85 g | 83 g |
| INTERNAL PRESSURE | 3.1 kg/cm$^2$ | 2.2 kg/cm$^2$ | 3.7 kg/cm$^2$ | 3.6 kg/cm$^2$ | 2.6 kg/cm$^2$ |
| USED DEVICE | NO | FOOT OPERATE DRILL | PIERCE WITH NEEDLE | NAIL | CAP |
| CAPACITY OF DEVICE | — | — | — | — | 150 ml |
| DISCHARGING METHOD | SPRAY OF CAN BODY | DRILL OF CAN BODY | PIERCE OF CAN BODY | DRILL OF CAN BODY | TURNING OF CAN UPSIDE DOWN |
| COATING ABSORBER | — | — | — | — | TISSUE PAPER |
| RESIDUAL COATING AFTER DISCHARGE | 4.5 g | 0 g | 40 g | 30 g | 45 g |
| INTERNAL PRESSURE AFTER DISCHARGE | 0.2 kg/cm$^2$ | 0 kg/cm$^2$ | 0 kg/cm$^2$ | 0 kg/cm$^2$ | 0.3 kg/cm$^2$ |
| STAINS AROUND CAN | A FEW | MANY | A FEW | MANY | NO |
| TIME FOR PUSH OF BUTTON | 9 MIN. | — | — | — | — |
| TIREDNESS OF FINGER | GREAT | — | — | — | — |

TABLE 3

| KIND OF COATING | LACQUER | ACRYLIC RESIN COATING | COATING FOR MARKING | WATER-BASE ACRYLIC COATING |
|---|---|---|---|---|
| TRADE NAME | ASAHIPEN LACQUER SPRAY | ASAHIPEN SPRAY FOR VARIOUS USES | ASAHIPEN MARKING SPRAY | ASAHIPEN WATER-BASE MINI SPRAY |
| COLOUR | WHITE | WHITE | WHITE | WHITE |
| CAPACITY | 300 ml | 300 ml | 300 ml | 100 ml |
| COMPOSITION | | | | |
| RESIN | 26.3 g | 31.6 g | 26.0 g | 10.5 g |
| PIGMENT | 15.9 g | 25.2 g | 20.3 g | 10.2 g |
| SOLVENT | 119.6 g | 59.1 g | 102.4 g | 14.6 g |
| WATER | — | — | — | 6.0 g |
| SPRAY AGENT | 79.3 g (DME/LPG) | 138.8 g (DME) | 99.2 g (DME) | 44.1 g (DME) |
| TOTAL | 241.1 g | 254.7 g | 247.9 g | 85.4 g |
| INTERNAL PRESSURE | 3.3~3.8 $kg/cm^2$ 20° C. | 3.8~4.3 $kg/cm^2$ 20° C. | 2.8~3.3 $kg/cm^2$ 20° C. | 3.7~4.2 $kg/cm^2$ 20° C. |

DME . . . Dimethylether
LPG . . . Liquefied Petroleum Gas

As obviously shown in the embodiments and the comparative tests, the methods of spraying residual liquid out by going on pushing a button, drilling or piercing a spray can body and setting a spray can body turned upside down to a cap for a spray can relating to the present invention cause problems such that a finger pushing a button is tired, surroundings around a spray can is stained and residual liquid is still left to be re-discharged. Whereas, when a cap for a spray can relating to the present invention is set to an erected spray can body, residual gas and liquid in the spray can can be safely and readily discharged at once without staining surroundings around the spray can.

We claim:

1. A cap for a spray can comprising:

a recess on a top panel;

said recess being engageable with an outer circumference of an engage portion surrounding a stem of a can body;

an insert hole into which the stem of the can body can be inserted being formed on said recess at a central part;

a narrow portion with a diameter smaller than an outer diameter of the stem of the can body being formed below said insert hole;

a stop plate against which residual liquid spouted from a discharge opening of the stem can strike, the stop plate being arranged at a necessary portion below said narrow portion;

two openings being formed at a connection portion of said narrow portion and said stop plate;

said top panel of the cap being liquid-proof except for said insert hole;

a liquid absorber which can absorb all liquid put inside the can body being arranged inside said cap;

wherein spouted residual liquid strikes against said stop plate jetting substantially towards an outer circumference of the cap from said openings by pushing down the stem of the can body with said narrow portion to spout the residual liquid and residual gas; and wherein spouted liquid is absorbed by said liquid absorber.

2. A cap for a spray can comprising:

a projection on a top panel;

said projection being engageable with an inner circumference of an engage portion surrounding a stem of a can body;

an insert hole into which the stem of the can body can be inserted being formed on said projection at a central part;

a narrow portion with a diameter smaller than an outer diameter of the stem of the can body being formed below said insert hole;

a stop plate against which residual liquid spouted from a discharge opening of the stem can strike, the stop plate being arranged at a necessary portion below said narrow portion;

two openings being formed at a connection portion of said narrow portion and said stop plate;

said top panel of the cap being liquid-proof except for said insert hole;

a liquid absorber which can absorb all liquid put inside the can body being arranged inside said cap;

wherein spouted residual liquid strikes against said stop plate jetting substantially towards an outer circumference of the cap from said openings by pushing down the stem of the can body with said narrow portion to spout the residual liquid and residual gas; and wherein scouted liquid is absorbed by said liquid absorber.

3. A cap for a spray can as set forth in claim 1, wherein said liquid absorber comprises either one or a combination of the following: felt, water absorptive paper, oil absorptive paper, sawdust and cloth.

4. A cap for a spray can as set forth in claim 2, wherein said liquid absorber comprises either one or a combination of the following: felt, water absorptive paper, oil absorptive paper, sawdust and cloth.

5. A cap for a spray can as set forth in claim 1, comprising a space with no block between one end of open surface side of the cap of said narrow portion and the stop plate which forms as a disk of a size larger than that of a discharge opening of the stem.

6. A cap for a spray can as set forth in claim 2, comprising a space with no block between one end of open surface side of the cap of said narrow portion and the stop plate which forms as a disk of a size larder than that of a discharge opening of the stem.

7. A spray can having the cap as set forth in claim 1.

8. A spray can having the cap as set forth in claim 2.

9. A spray can having the cap as set forth in claim 3.

10. A spray can having the cap as set forth in claim 4.

11. A spray can having the cap as set forth in claim 5.

12. A spray can having the cap as set forth in claim 6.

13. A method for discharging residual liquid and gas in a spray can comprising the steps of:

providing a recess on a top panel of a cap for the spray can which is engageable with an outer circumference of an engage portion surrounding a stem of a can body;

forming an insert hole into which the stem of the can body can be inserted on said recess at a central part;

forming a narrow portion with a diameter smaller than an outer diameter of the stem of the can body below said insert hole;

arranging a stop plate against which the residual liquid spouted from a discharge opening of the stem can strike at a necessary portion below said narrow portion;

forming two openings at a connection portion of said narrow portion and said stop plate;

making said top panel liquid-proof except for said insert hole;

arranging inside said cap a liquid absorber which can absorb all liquid put inside the can body;

erecting the can body and setting the cap upside down with its open surface turning upwardly to the erected can body; and pushing down the stem of the can body with said narrow portion to spout the residual liquid and gas and striking the spouted residual liquid against said stop plate to jet substantially towards an outer circumference of the cap from said openings with the residual liquid stored within the cap, said liquid absorber being made to absorb the spouted liquid.

14. A method for discharging residual liquid and gas in a spray can comprising the steps of:

providing a projection on a top panel of a cap for the spray can which is engageable with an inner circumference of an engage portion surrounding a stem of a can body;

forming an insert hole into which the stem of the can body can be inserted being on said projection at a central part;

forming a narrow portion with a diameter smaller than an outer diameter of the stem of the can body below said insert hole;

arranging a stop plate against which the residual liquid spouted from a discharge opening of the stem can strike at a necessary portion below said narrow portion;

forming two openings at a connection portion of said narrow portion and said stop plate;

making said top panel liquid-proof except for said insert hole;

arranging inside said cap a liquid absorber which can absorb all liquid put inside the can body;

erecting the can body and setting the cap upside down with its open surface turning upwardly to the erected can body; and pushing down the stem of the can body with said narrow portion to spout the residual liquid and gas and striking the spouted residual liquid against said stop plate to jet substantially towards an outer circumference of the cap from said openings with the residual liquid stored within the cap, said liquid absorber being made to absorb the scouted liquid.

15. A method for discharging residual liquid and gas in a spray can as set forth in claim 13, wherein said liquid absorber comprises either one or a combination of the following: felt, water absorptive paper, oil absorptive paper, sawdust and cloth.

16. A method for discharging residual liquid and gas in a spray can as set forth in claim 14, wherein said liquid absorber comprises either one or a combination of the following: felt, water absorptive paper, oil absorptive paper, sawdust and cloth.

17. A method for discharging residual liquid and gas in a spray can as set forth in claim 13, wherein a space with no block between one end of the open surface side of the cap of the narrow portion and the stop plate is formed;

wherein the stop plate forms as a disk of a size larger than that of a discharge opening of the stem; and wherein the liquid spouted from the stem is made to jet towards outer circumference by striking against the disk-formed stop plate after the spouted liquid is made to go through the space.

18. A method for discharging residual liquid and gas in a spray can as set forth in claim 14, wherein a space with no block between one end of the open surface side of the cap of the narrow portion and the stop plate is formed;

wherein the stop plate forms as a disk of a size larger than that of a discharge opening of the stem; and wherein the liquid spouted from the stem is made to jet towards outer circumference by striking against the disk-formed stop plate after the spouted liquid is made to go through the space.

* * * * *

UNITED STATES PATENT AND TRADEMARK OFFICE

CERTIFICATE OF CORRECTION

PATENT NO. : 6,000,579

DATED : December 14, 1999

INVENTOR(S) : Hiromasa Sugimoto et al.

It is certified that error appears in the above-identified patent and that said Letters Patent is hereby corrected as shown below:

Col. 12, line 45
replace "scouted"
with --spouted--.

Col. 14, line 14
replace "scouted"
with --spouted--.

Signed and Sealed this

Eighth Day of August, 2000

*Attest:*

*Attesting Officer*

Q. TODD DICKINSON

*Director of Patents and Trademarks*